US006155733A

United States Patent [19]

Holbrook et al.

[11] Patent Number: 6,155,733

[45] Date of Patent: Dec. 5, 2000

[54] ADJUSTABLE MULTI-TIP MARKER

[76] Inventors: Paul Robert Holbrook; Lori Sue Holbrook, both of 2218 Miramar La., Buffalo Grove, Ill. 60089

[21] Appl. No.: 09/574,027

[22] Filed: May 19, 2000

[51] Int. Cl.[7] ..... B43K 27/00

[52] U.S. Cl. ..... 401/31; 401/29; 401/23

[58] Field of Search ..... 401/31, 30, 29, 401/32, 33, 23

[56] References Cited

U.S. PATENT DOCUMENTS

| | | | |
|---|---|---|---|
| 607,708 | 7/1898 | Seidel | 401/31 |
| 4,580,918 | 4/1986 | Baker . | |
| 4,692,046 | 9/1987 | Lan | 401/32 |
| 5,026,189 | 6/1991 | Keil . | |
| 5,203,638 | 4/1993 | Redmond, Jr. | 401/29 |
| 5,813,787 | 9/1998 | Dowzall . | |

*Primary Examiner*—David J. Walczak

[57] ABSTRACT

A writing implement with three or more non-coaxial optionally selectable writing tips to produce lines of different thicknesses and to create unique and distinct "outlining" or "highlighting" effects. It is particularly adapted to be used on fibrous or felt tip type highlighter markers, but could be used on a variety of writing implements. The Meriting implement is comprised of a hollow low body supporting a fixed writing tip, a reservoir in the body holding a supply of ink, a series of two or more retractable tips slidably arranged alongside the fixed tip and adjusting means attached to each retractable tip to axially move each retracting tip to first and second operating positions, so that when moved to and locked in the first operative position, each retractable tip is extended with respect to the fixed tip, and when moved to and locked in the second operative position, each retractable tip is retracted with respect to the fixed tip. All tips are made of a porous material having capillary channels and being in fluid communication with the ink reservoir.

2 Claims, 5 Drawing Sheets

ADJUSTABLE MULTI-TIP MARKER

RELATED APPLICATIONS

None

FEDERALLY SPONSORED RESEARCH/ DEVELOPMENT

None

MICROFICHE APPENDIX

None

BACKGROUND OF THE INVENTION

1. Field of the invention

The present invention relates to writing implements, in particular felt and fiber tip marker pens and liners, with three or more non-coaxial optionally usable writing tips.

2. Prior Art

There are known many methods of drawing lines of different widths with a single writing implement. There has been proposed a pen with a body to which may be attached any one of a series of writing heads fitted with tips of different sizes (see U.S. Pat. No. 5,813,787). However, the need to replace the writing head each time the line width is to be changed is very inconvenient.

It is also known to provide a pen with a broad tip so that lines of variable width can be produced by moving the pen across the paper with the nib at different angles to the direction of movement. In this case considerable skill and dexterity are required to produce lines of uniform width.

A writing implement is also known in which one writing tip is located in each of the two opposite ends of the body of the implement, both writing tips being of different thicknesses. Here, too, the handling is tedious, since in the case of changing line thickness the writing implement must be turned around. This method also provides for only two discrete line thicknesses.

There are also a number of writing implements which employ coaxial writing tips (sec U.S. Pat. Nos. 4,580,918 and 5,026,189) and means for advancing and retracting the tips relative to one another to adjust a selected tip into an operative writing position, whereby the implement is adjustable to produce lines of different predetermined widths.

However, none of the above methods provides a means to "outline" printed information in a variety of patterns, specifically when using the transparent ink which is commonly found in "highlighters." This would be especially advantageous when the media on the printed sheet which is desired to be highlighted is easily smeared or smudged, such as the case with pencil, felt tip marker, or wet ink, the latter commonly occurring with fresh printouts from "ink jet" type printers. An additional benefit of hating 3 or more optional writing tips is providing a greater range of possible line widths than is provided with the coaxial arrangement.

SUMMARY OF THE INVENTION

This invention provides a writing implement with 3 or more non-coaxial optionally selectable writing tips. It is particularly adapted to be used on fibrous or felt tip type highlighter markers, but could be used on a variety of writing implements. The writing implement is comprised of a hollow body supporting a fixed writing tip, a reservoir in the body holding a supply of ink, a series of two or more retractable tips slidably arranged alongside the fixed tip and adjusting means attached to each retractable tip to axially move each retracting tip to first and second operating positions, so that when moved to and locked in the first operative position, each retractable tip is extended with respect to the fixed tip, and when moved to and locked in the second operative position, each retractable tip is retracted with respect to the fixed tip. All tips are made of a porous material having capillary channels and being in fluid communication with the ink reservoir.

This design provides for two distinct advantages: first, lines of a variety of different thickness may be made with a single writing implement, simply by alternately extending and retracting individual tips. The number of discrete line thicknesses which may be achieved is limited only by the number of retractable tips. Secondly, by retracting any combination of interior retractable tips, "outline" patterns may be achieved, in the event the user does not wish to actually "highlight" particular printed sheet media, or merely to achieve a more distinct and unique highlight effect. For example, with three tips, if the center tip is retracted, and the other retractable tip is extended, then two lines will be drawn with a space in the middle equal to the thickness of the center tip. In another example, with 5 tips, if the second and fourth tips were retracted, and the third and fifth tips extended, then a pattern with 3 lines with two spaces in the middle would be created. Once again, the number and variety of highlighting effects is only limited by the number of retractable tips used.

In the preferred embodiment, the retractable tips are alternately retracted and extended by employing the mechanism commonly found in "click" style ball point pens. Namely, each retractable tip is spring loaded such that the tip is biased in the retracted position. The end cap used to seal off the end of the hollow body opposite the writing tips has a series of longitudinally grooved bores (one bore per retractable nib), which engage a similar series of features on each tip actuator, such that each actuator is free to move longitudinally but not rotationally. Each actuator impinges on a two position cam with alternating longitudinal ribs, the number of ribs being equal to half the number of longitudinal grooves in the end cap bore. When the cam is in a first position, the alternating longitudinal ribs impinge on the interior surface of the end cap and secure the respective tip in the extended position. When the cam is in a second position, the alternating ribs engage the longitudinal grooves in the end cap bores, allowing the tip to retract.

BRIEF DESCRIPTION OF THE DRAWINGS

The foregoing aspects and other features of the present invention are explained in the following description, taken in combination with the accompanying drawings, wherein:

FIG. 1 shows the writing implement with both retractable tips in the retracted position.

FIG. 2 shows the writing implement with the retractable tip adjacent to the fixed nib in the extended position, and the other retractable tip in the retracted position FIG. 3 shows the writing implement with both retractable tips in the extended position.

FIG. 4 shows the writing implement with the retractable tip adjacent to the fixed tip in the retracted position, and the other retractable tip in the extended position.

DETAILED DESCRIPTION OF THE INVENTION

Figure 1:
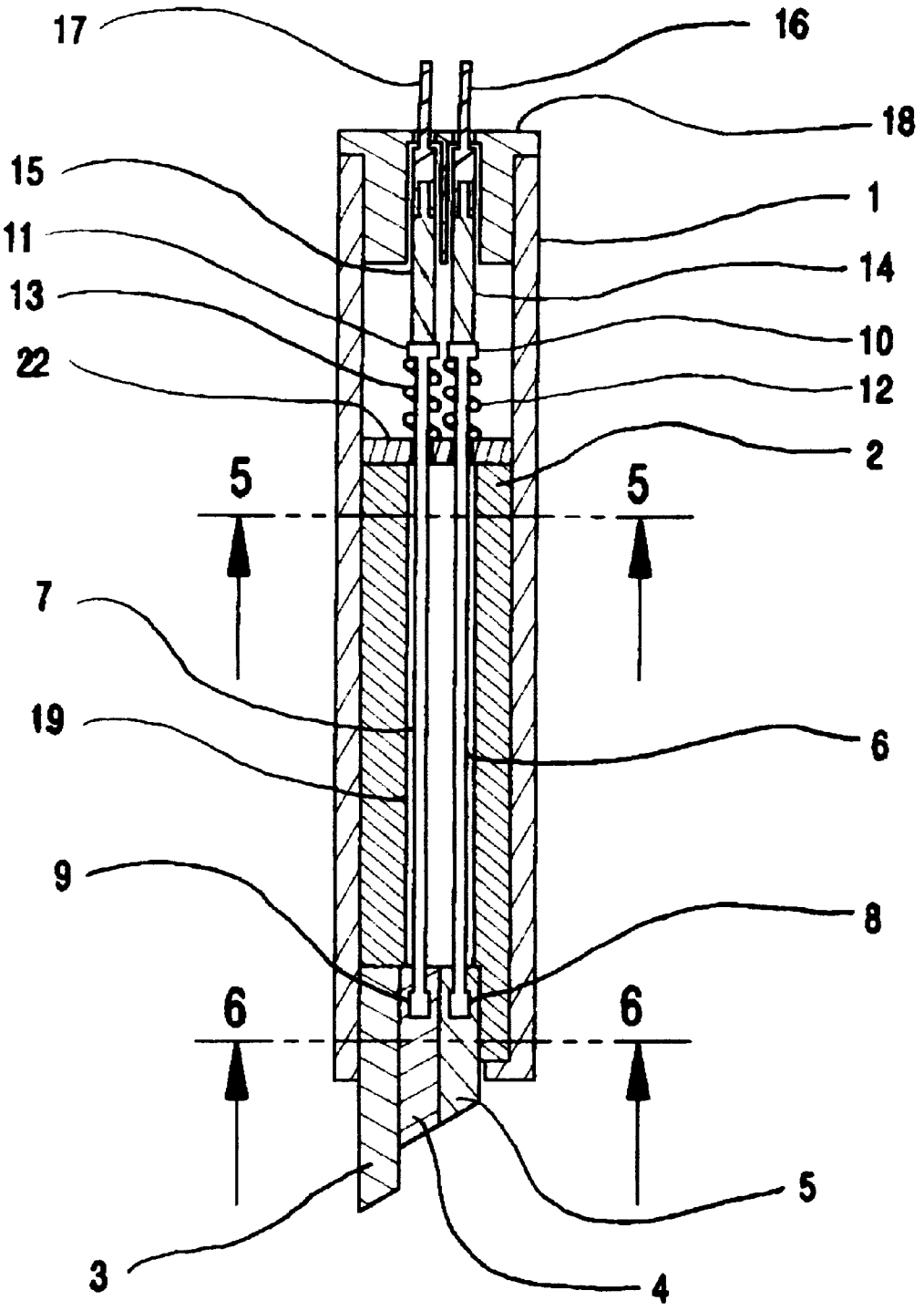
FIGS. 1 through 4 are section views taken through a central plane which is aligned with the central axis of the writing implement, with the implement having one fixed and two retractable writing tips.

Referring to FIG. 1, there is shown a section view of the writing implement. Although the present invention will be described with reference to the single embodiment shown in the drawings, it should be understood that the present invention can be embodied in many alternate forms or embodiments. In addition, any suitable size, shape or type of elements or materials could be used.

Still referring to FIG. 1, the writing implement is comprised of a hollow body 1 which supports a fixed writing tip 3, an ink reservoir tampon 2, two retractable tips 4 and 5, tip actuators 16 and 17, cams 14 and 15, springs 12 and 13, end cap 18 and connecting rods 6 and 7. The implement is shown with both retractable tips 4 and 5 in the retracted position. Connecting rod 6 is attached to tip 5 at point 8, and similarly connecting rod 7 is attached to tip 4 at point 9. Springs 12 and 13 bias the tips in the retracted position, acting between shoulders 10 and 11 of connecting rods 6 and 7 and intermediate plate 22. Ink reservoir 2 has bore 19 through which connecting rods 6 and 7 are allowed to pass.

Figure 2:
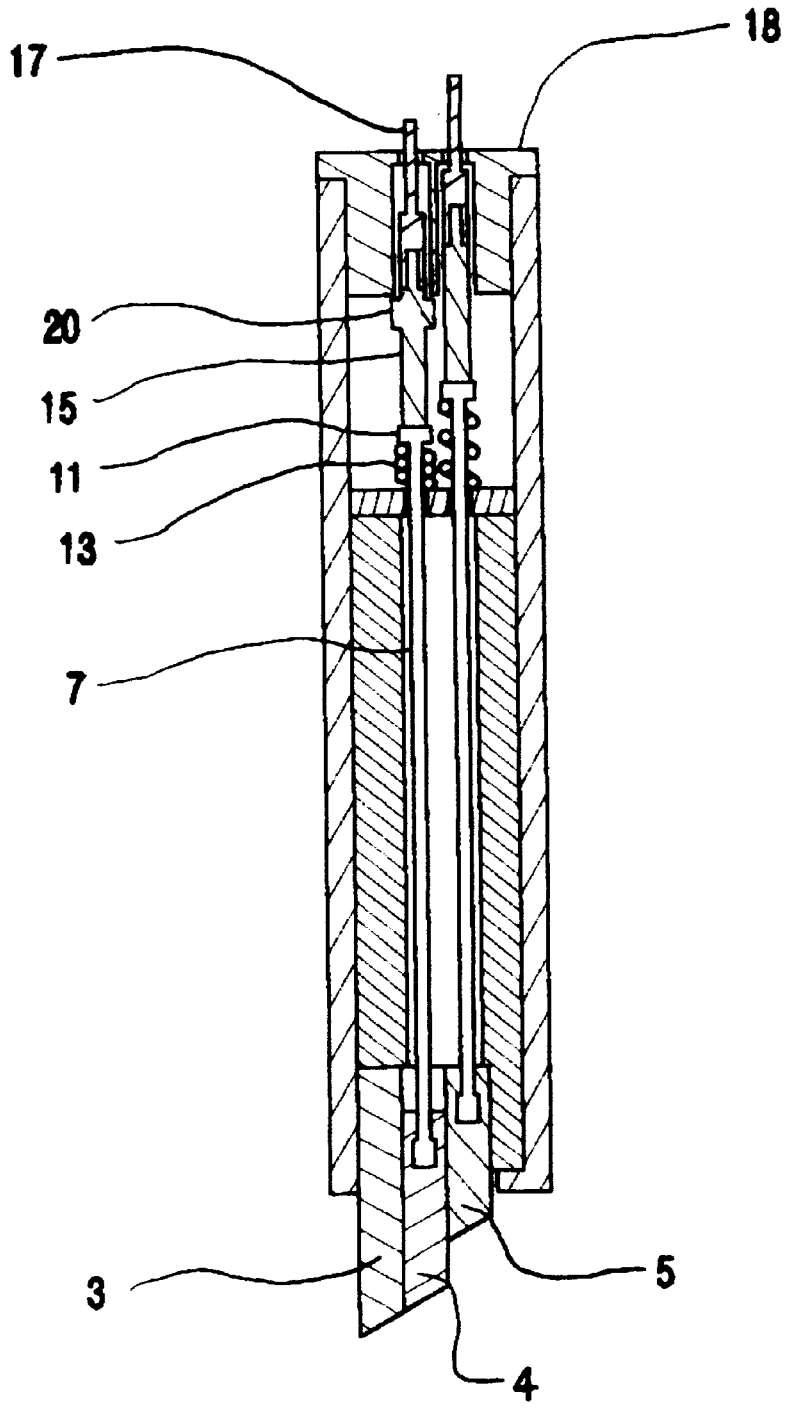

Referring now to FIG. 2, the writing implement is shown with tip 4 extended and tip 5 retracted, allowing for creation of greater thickness lines. To actuate tip 4 from the retracted to the extended position, the user would push actuator 17 to its furthest axial extent, then release, allowing longitudinal ribs 20 on cam 15 to engage the interior surface of the end cap 18, and locking tip 4 in the extended position.

Figure 3:
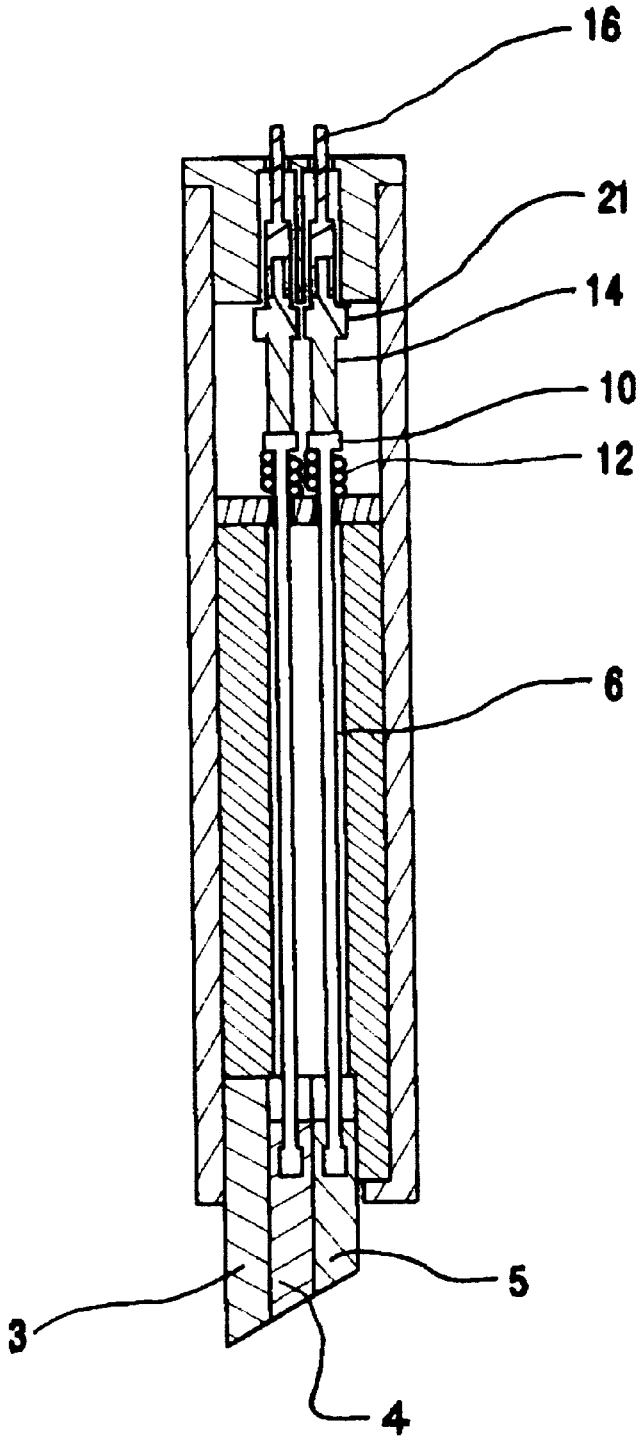

Referring now to FIG. 3, the writing implement is shown with tips 4 and 5 extended, providing for creation of even greater thickness lines. Tip actuator 16 is similarly actuated, allowing similar ribs 21 on cam 14 to engage end cap interior surface, locking tip 5 in extended position.

Figure 4:
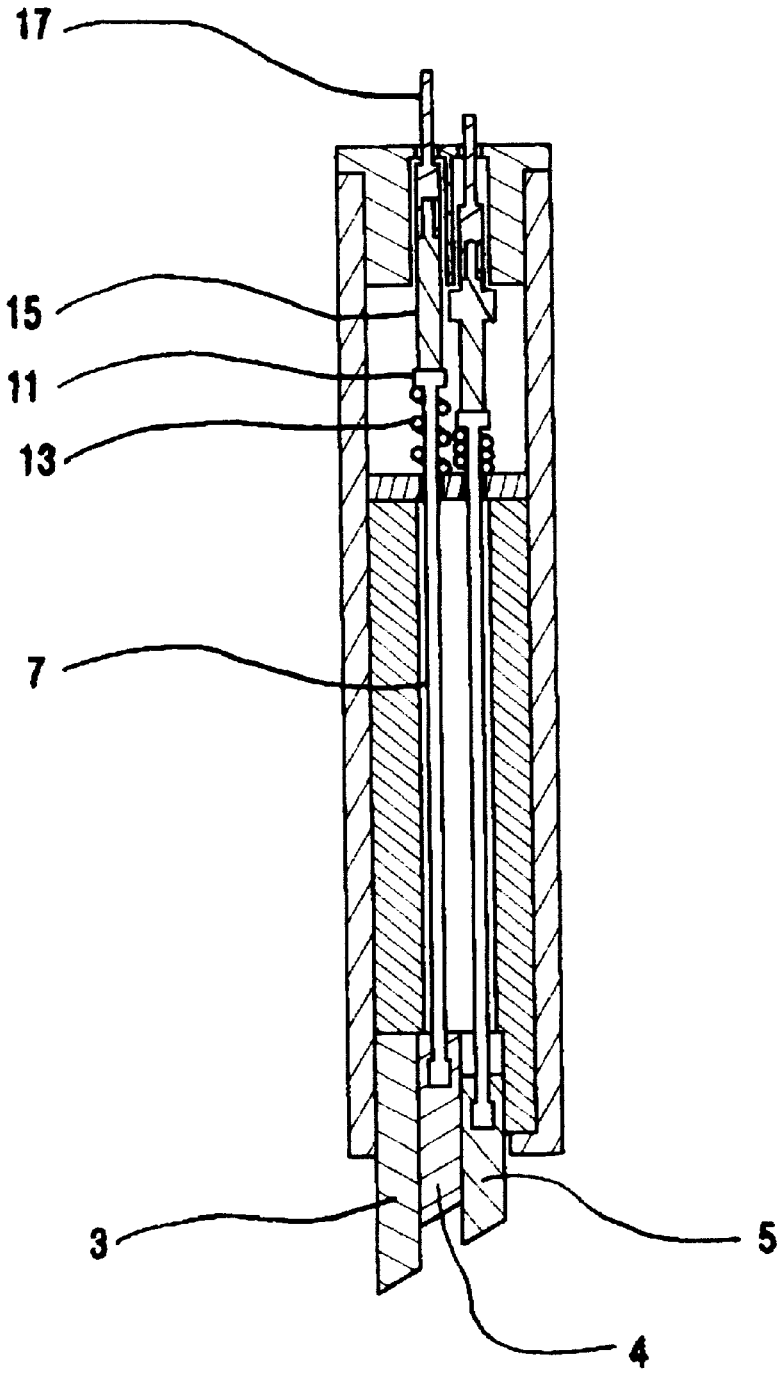

Referring now to FIG. 4, the writing implement is shown with tip 4 retracted and tip 5 extended, allowing for an "outline" effect.

Figure 5:
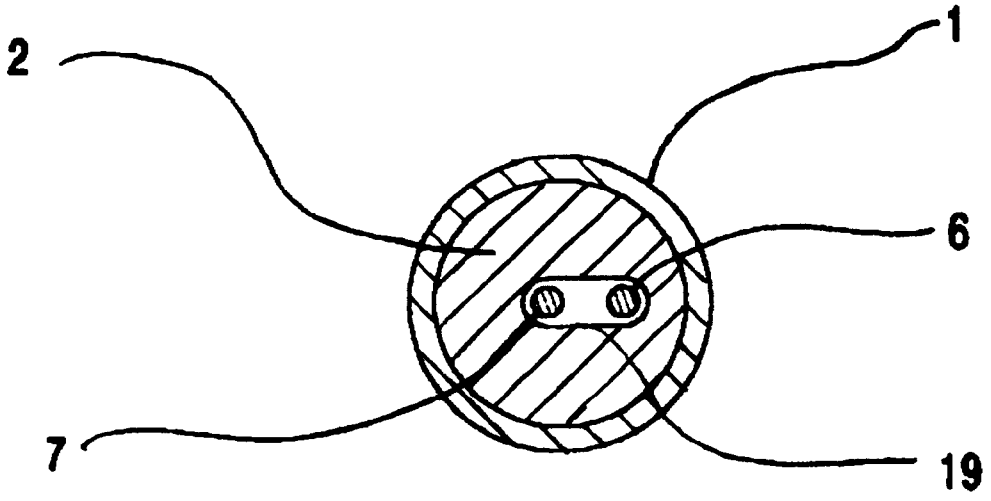
FIGS. 5 and 6 are section views taken through two planes which are perpendicular to the central axis of the writing implement.

Referring now to FIG. 5, body 1 is shown capturing ink reservoir 2, with bore 19 allowing connecting rods 6 and 7 to pass through.

Figure 6:
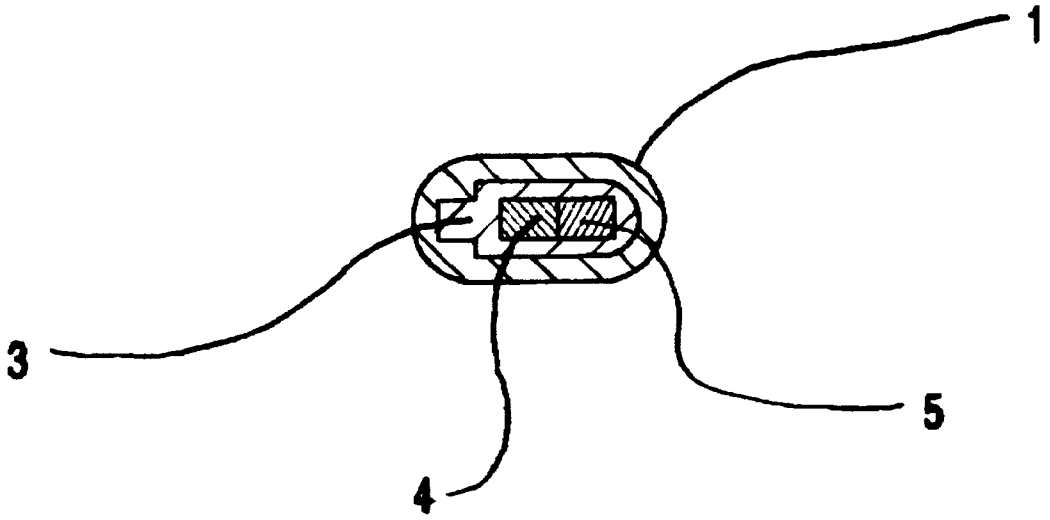

Referring now to FIG. 6, body 1 is shown capturing fixed tip 3, with retractable tips 4 and 5 allowed to slide axially with respect to fixed tip 3.

It should be understood that the foregoing description is only illustrative of the invention. Various alternatives and modifications can be devised by those skilled in the art without departing from the invention. Accordingly, the present invention in intended to embrace all such alternatives, modifications and variances that fall within the scope of the appended claims.

What is claimed is:

1. A writing implement comprising:

A hollow body extending along and centered on an axis, and a reservoir tampon in the body holding a supply of ink, and a fixed writing tip having a rear end contacting the reservoir tampon and a front end, and two or more retractable writing tips, and an adjusting means communicating with each retractable tip to individually axially move each retractable tip with respect to the fixed tip to first and second operative positions and to releasably lock each retractable tip in the first and second operative positions, so that when moved to and locked in the first operative position, each retractable tip is extended into writing alignment with the fixed tip, and when moved to and locked in the second operative position, each retractable tip is retracted with respect to the fixed tip, and all tips being made of a porous material having capillary channels and being in fluid communication with said ink resevoir.

2. A device as described in claim 1, wherein said adjusting means is a combination of:

a user operated tip actuator slidably mounted in end cap of said hollow body, a cam, and a spring which biases each retractable tip toward the retracted position.

* * * * *